US007576762B2

(12) United States Patent
Ueda

(10) Patent No.: US 7,576,762 B2
(45) Date of Patent: Aug. 18, 2009

(54) RECORDING UNIT

(75) Inventor: Kazuo Ueda, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/146,860

(22) Filed: Jun. 26, 2008

(65) Prior Publication Data

US 2009/0066745 A1 Mar. 12, 2009

(30) Foreign Application Priority Data

Sep. 12, 2007 (JP) ..... 2007-236528

(51) Int. Cl.
*B41J 29/377* (2006.01)

(52) U.S. Cl. ..... 347/223

(58) Field of Classification Search ..... 347/223
See application file for complete search history.

(56) References Cited

FOREIGN PATENT DOCUMENTS

JP 6-31957 2/1994
JP 2006-205666 * 8/2006
JP 2006-212818 8/2006

* cited by examiner

*Primary Examiner*—Huan H Tran
(74) *Attorney, Agent, or Firm*—Brinks Hofer Gilson & Lione

(57) ABSTRACT

A recording unit is mounted on a thermal transfer printer in which heating elements of a thermal head are heated to thermally transfer ink a recording material. The recording unit includes a head unit having the thermal head; and a cooling unit having a cooling medium flow path for circulating a cooling medium to cool the thermal head. The cooling unit is configured to cause the head unit to be held at an immovable state relative to the cooling medium flow path so as to surround the cooling medium flow path by the pressure contact of the cooling medium flow path by means of a pressure contact and release mechanism. Separation of the head unit from the cooling unit body is allowed by the release of the pressure contact and release mechanism.

5 Claims, 14 Drawing Sheets

RECORDING UNIT

RELATED APPLICATIONS

This application claims the benefit of priority under 35 U.S.C. §119 to Japanese Patent Application No. 2007-236528 filed Sep. 12, 2007, the contents of which are hereby incorporated by reference in their entirety.

BACKGROUND OF THE DISCLOSURE

1. Field of the Disclosure

The present disclosure relates to a recording unit, and more particularly, to a recording unit which can be suitably used when a head unit with a thermal head is to be replaced.

2. Description of the Related Art

In the past, thermal transfer printers have been used which print characters or images on a recording material such as printing paper using a thermal head with heating or thermal elements formed thereon. Specifically, in the thermal transfer printers, the thermal head is brought into pressure contact with printing paper on a platen with an ink ribbon disposed between them. In the meantime, the heating or thermal elements are selectively heated in accordance with printing data, whereby ink of the ink ribbon is transferred onto the recording material; that is, thermal transfer printing is carried out.

In such thermal transfer printers, when the heating temperature of the heating or thermal elements is too high, too much of the ink of the ink ribbon is transferred onto the recording material, resulting in poor quality printing.

To solve or alleviate such a problem, in the conventional thermal transfer printers, cooling of the thermal head was carried out by forcibly radiating heat generated from the thermal head to the outside via a radiator member (for example, a thermal head attachment mount) coupled to the thermal head.

In recent years, a water-cooled cooling unit has been employed to more effectively cool down the thermal head by using cooling liquid (for example, see Patent Document 1: JP-A-6-031957). In the water-cooled cooling unit, a flow path for circulating the cooling liquid is provided in the vicinity of the thermal head, and heat transferred from the thermal head to the flow path is transformed to evaporation heat of the cooling liquid that circulates in the flow path to thereby cool down the thermal head.

Moreover, the present applicant has proposed a cooling unit configured to be detachably attached to a head unit with a thermal head in order to make it easy to replace a destroyed or fatigued thermal head with a new one (see Patent Document 2: JP-A-2006-212818). According to the cooling unit, the replacement of the thermal head can be performed in a state that the head unit is separated from the cooling unit. Unlike a cooling unit that is not separable from the head unit, it is not necessary to stop the circulation of cooling liquid and evacuate the cooling liquid in order to prevent leaking of the cooling liquid during the replacement of the thermal head. Therefore, the replacement of the thermal head becomes easy.

However, in the cooling unit (heat sink) of Patent Document 2, the attachment and detachment of the head unit is carried out by means of bolts and nuts, which requires considerable time. Therefore, a construction is desired which enables replacement of the thermal head in an easier manner.

SUMMARY OF THE DISCLOSURE

The present disclosure provides a recording unit mounted on a thermal transfer printer in which heating or thermal elements of a thermal head are heated so that ink of an ink ribbon is thermally transferred to a recording material. The recording unit comprises: a head unit having the thermal head; and a cooling unit having a cooling medium flow path for circulating a cooling medium to thereby cool down the thermal head by the cooling medium. The cooling unit is fixed at a predetermined position in a thermal transfer printer body, and the head unit is detachably attached to the cooling unit. The head unit is provided with a cavity through which a head unit body is loosely fit to the cooling unit in a predetermined loose fit direction in such a manner as to surround the cooling medium flow path, the cavity being surrounded by a heat transfer member that is arranged so as to be opposed to the cooling medium flow path to receive heat generated from the thermal head in a state where the head unit body is loosely fit to the cooling unit and a holder having a wall portion opposed to the heat transfer member. The cooling unit comprises: a lever that is pivotable between a first pivot position and a second pivot position; and a pressure contact and release mechanism that is configured to bring the cooling medium flow path into pressure contact with the heat transfer member in accordance with the pivot operation of the lever toward the first pivot position when the head unit body is at the loose fit state and to release the pressure contact of the cooling medium flow path in accordance with the pivot operation of the lever toward the second pivot position in a state where the cooling medium flow path is in pressure contact with the heat transfer member. The cooling unit is configured to cause the head unit to be held at an immovable state relative to the cooling medium flow path in such a manner as to surround the cooling medium flow path by the pressure contact of the cooling medium flow path by means of the pressure contact and release mechanism. Thus, the head unit is attached to the head unit body in such a state that cooling of the thermal head can be carried out by the cooling medium flow path, and separation of the head unit from the cooling unit body is allowed by the release of the pressure contact by means of the pressure contact and release mechanism.

As a result of using the recording unit according to the present disclosure, it is possible to perform replacement of a thermal head in an easy and quick manner.

BRIEF DESCRIPTION OF THE DRAWINGS

The components in the figures are not necessarily to scale, emphasis instead being placed upon illustrating the principles of the disclosure. Moreover, in the figures, like reference numerals designate corresponding parts throughout the different views.

DESCRIPTION OF THE EMBODIMENTS

Exemplary embodiments may be better understood with reference to the drawings, but these examples are not intended to be of a limiting nature. Like numbered elements in the same or different drawings perform equivalent or corresponding functions.

Hereinafter, a recording unit according to an embodiment of the present disclosure will be described with reference to FIGS. 1 to 14.

Figure 1:
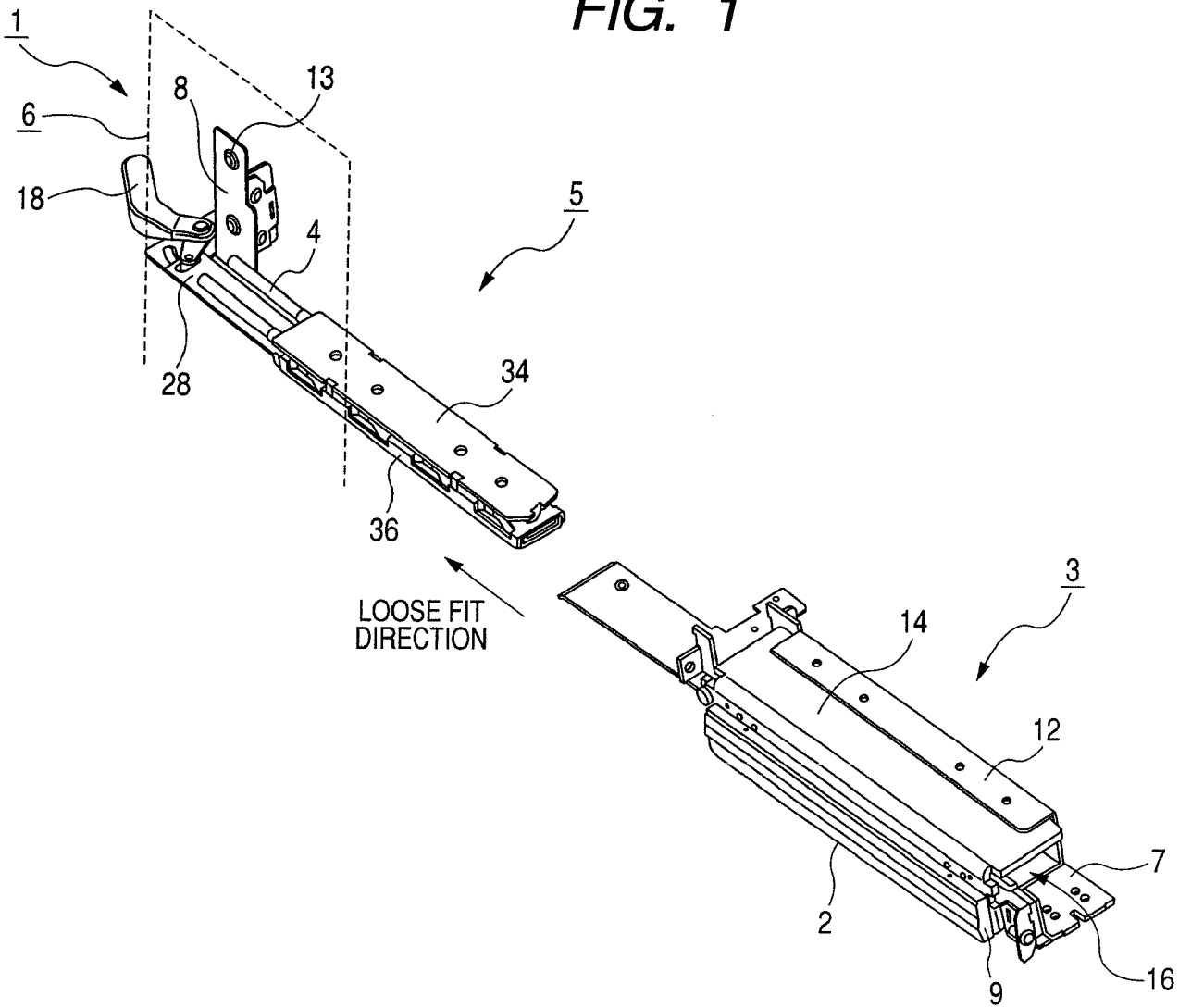
FIG. 1 is a perspective view of a recording unit according to an embodiment of the present disclosure, showing the state in which a head unit is separated from a cooling unit.

As shown in FIG. 1, the recording unit 1 of the present embodiment includes a head unit 3 having a line thermal head 2 with heating or thermal elements formed thereon, and a cooling unit 5 for cooling the line thermal head 2 by means of cooling water that circulates in a circulation pipe 4 as a cooling medium flow path.

The recording unit 1 is mounted on a thermal transfer printer operable to heat the heating or thermal elements of the line thermal head 2 to thereby thermally transfer ink of an ink ribbon on a recording material. Specifically, the cooling unit 5 is fixed at a predetermined position in a thermal transfer printer body 6 while the head unit 3 is detachably attached to the cooling unit 5. Moreover, the cooling unit 5 may be fixed to the thermal transfer printer body 6 at an accommodation part (for example, a ribbon cassette) in which the ink ribbon is wound and accommodated (for example, see FIG. 1 of Patent Document 2).

Next, the head unit 3 will be described in detail. The head unit 3 has a base frame 7 that is elongated in a direction perpendicular to the sheet surface in FIG. 2. The base frame 7 is fixed at a predetermined position in the thermal transfer printer body 6 via a fixing means such as bolts (not shown) when the head unit 3 is at an attachment state to the cooling unit 5.

Figure 2:
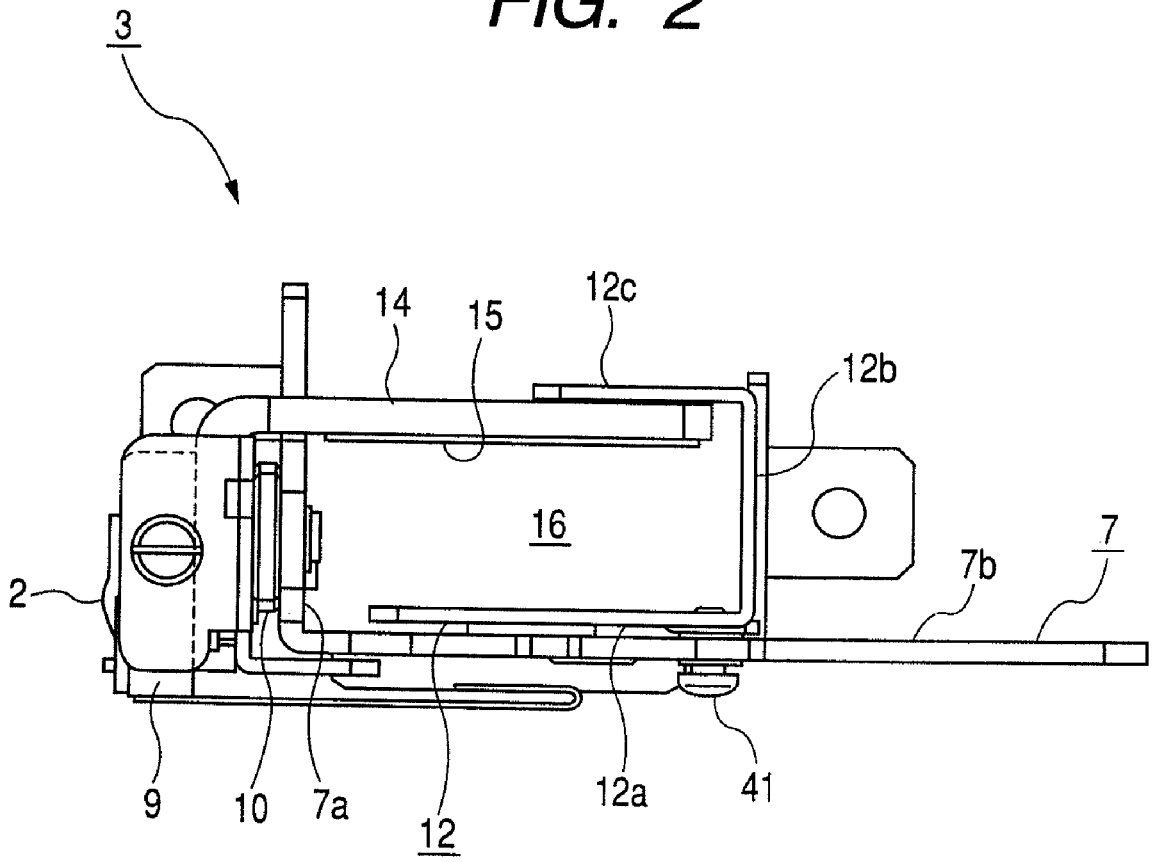
FIG. 2 is a right side view of the head unit of the recording unit according to the embodiment of the present disclosure.

The base frame 7 has a frame sidewall portion 7*a* that extends in a direction parallel to the vertical direction of FIG. 2. A head attachment mount 9 that is elongated in a direction perpendicular to the sheet surface in FIG. 2 is fixed to the frame sidewall portion 7*a* via a fixing means 10 such as bolts.

The line thermal head 2 is mounted on the head attachment mount 9 in a state in which a formation surface of the heating or thermal elements faces the left side in FIG. 2.

In addition, when performing thermal transfer printing, the line thermal head 2 makes pressure contact with a platen roller (not shown) of the thermal transfer printer in a direction from the left side in FIG. 2.

Moreover, the base frame 7 has a frame bottom wall portion 7*b* that extends from the lower end in FIG. 2 of the frame sidewall portion 7*a* toward the right side in FIG. 2. A generally inverted C-shaped holder 12 is arranged on the frame bottom wall portion 7*b*.

The holder 12 is formed by a holder bottom wall portion 12*a* arranged above the frame bottom wall portion 7*b* in a direction parallel to the frame bottom wall portion 7*b*, a holder sidewall portion 12*b* extending upward from above the right end in FIG. 2 of the holder bottom wall portion 12*a* in a direction parallel to the frame sidewall portion 7*a*, and a holder top wall portion 12*c* extending from the upper end of the holder sidewall portion 12*b* toward the right side in FIG. 2 in a direction parallel to the holder bottom wall portion 12*a*.

In the present embodiment, a metallic radiator plate 14 is arranged so as to extend from the rear surface (the right end surface in FIG. 2) of the head attachment mount 9 to the bottom surface of the holder top wall portion 12*c*. A thermally conductive sheet 15 is glued to a portion of the radiator plate 14 opposite the holder bottom wall portion 12*a*. The radiator plate 14 and the thermally conductive sheet 15 serve as a heat transfer member. That is, heat generated from the line thermal head 2 by the heating of the heating or thermal elements is transferred via the head attachment mount 9 to the radiator plate 14 and the thermally conductive sheet 15.

In addition, in the present embodiment, by a space surrounded by the radiator plate 14, the thermally conductive sheet 15 and the holder 12, there is formed a cavity 16 having a rectangular shape (in side view) that is elongated in a direction perpendicular to the sheet surface in FIG. 2. Therefore, the head unit 3 can be loosely fit to the cooling unit 5 through the cavity 16 from a loose fit direction, which extends in a direction perpendicular to the sheet surface in FIG. 2, so as to surround the circulation pipe 4.

Figure 3:
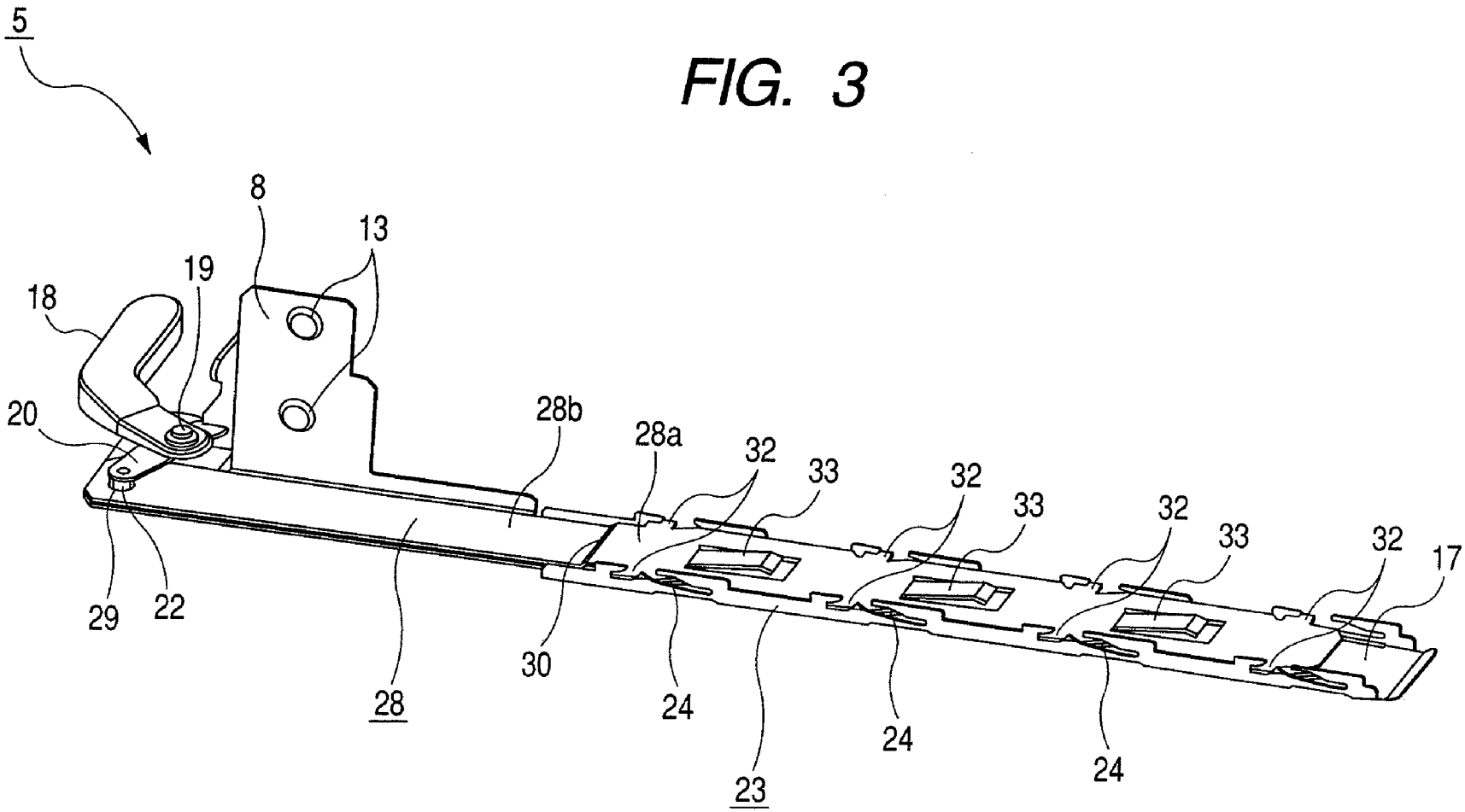
FIG. 3 is a perspective view of the recording unit according to the embodiment of the present disclosure, showing an attachment and detachment lever at a pivot state toward a pressure contact pivot position and a plate spring member at a movement state toward a pressure contact movement position and a pressure contact cam position.
Figure 4:
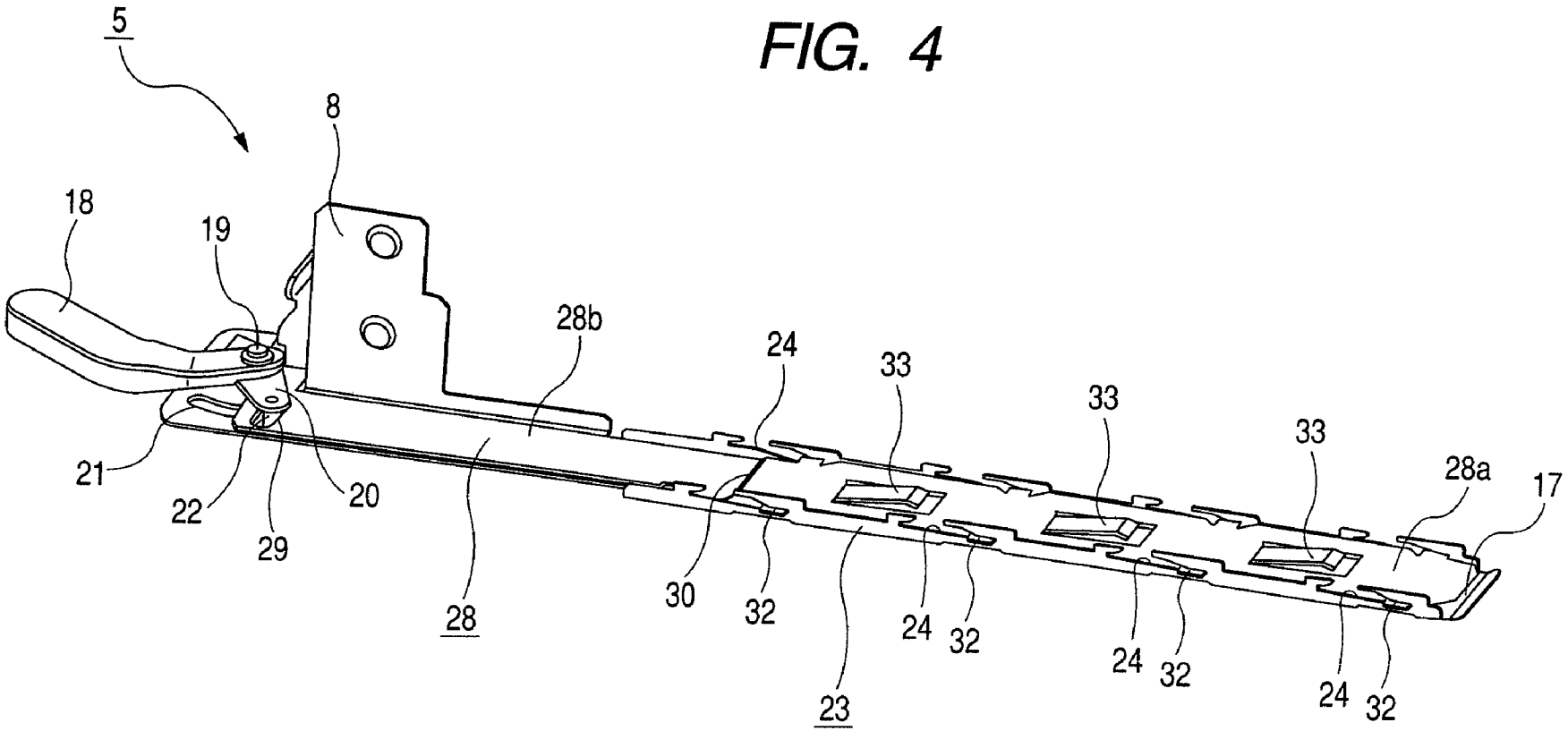
FIG. 4 is a perspective view of the receiving unit according to the embodiment of the present disclosure, showing an attachment and detachment lever at a pivot state toward a release pivot position and a plate spring member at a movement state toward a release movement position and a release cam position.

Next, the cooling unit 5 will be described in detail. As shown in FIGS. 3 and 4, the cooling unit 5 has an elongated board-like base portion 17.

On an end portion in a width direction of the base portion 17 perpendicular to a longitudinal direction thereof and in the vicinity of one end (the left end portion in FIGS. 3 and 4) in the longitudinal direction of the base portion 17, there is standing a board-like fixing portion 8 configured to be threadably coupled with a fastening member 13 such as bolts. The cooling unit 5 is fixed to the thermal transfer printer body 6 via the fixing portion 8.

In addition, in the vicinity of one end (the left end portion in FIGS. 3 and 4) in the longitudinal direction of the base portion 17, a dog-leg shaped attachment and detachment lever 18 is supported so as to be pivotable about a pivot shaft 19 that is perpendicular to the base portion 17.

On the same shaft as the attachment and detachment lever 18, a link portion 20 that is perpendicular to the proximal portion of the attachment and detachment lever 18 is arranged parallel to the base portion 17. The link portion 20 is configured to pivot about the same shaft as the attachment and detachment lever 18 in an integral manner.

In a portion of the base portion 17 in the vicinity of the attachment and detachment lever 18, a circular arc-shaped, elongated pivot regulation opening 21 is formed along a pivot trajectory that the distal end of the link portion 20 traces. In the elongated pivot regulating opening 21, a pivot regulation pin 22 that is rotatably provided at the distal end of the link portion 20 so as to protrude downward is inserted from the above in FIGS. 3 and 4.

The pivot regulation pin 22 pivots inside the elongated, pivot regulation opening 21 in accordance with the pivot operation of the attachment and detachment lever 18 and the link portion 20, and makes abutting contact with both extreme ends in the pivot direction of the inner circumferential surface of the elongated, pivot regulation opening 21.

With this configuration, the allowed pivot range of the attachment and detachment lever 18 is regulated so that it can perform the pivot operation between a first pivot position (hereinafter, referred to as a pressure contact pivot position) as shown in FIG. 3 and a second pivot position (hereinafter, referred to as a release pivot position) as shown in FIG. 4.

At both ends in the width direction of the base portion 17, a paired cam forming body 23 is formed so as to protrude upward in FIGS. 3 and 4, wherein the cam forming body 23 is elongated in the longitudinal direction of the base portion 17, and wherein the cam forming body 23 extends within a predetermined range of the base portion 17 from one end at a side opposite to the attachment and detachment lever 18 toward the other end close to the attachment and detachment lever 18. In the paired cam forming body 23, mutually identical cam shapes are formed at mutually the same longitudinal positions.

Figure 5:
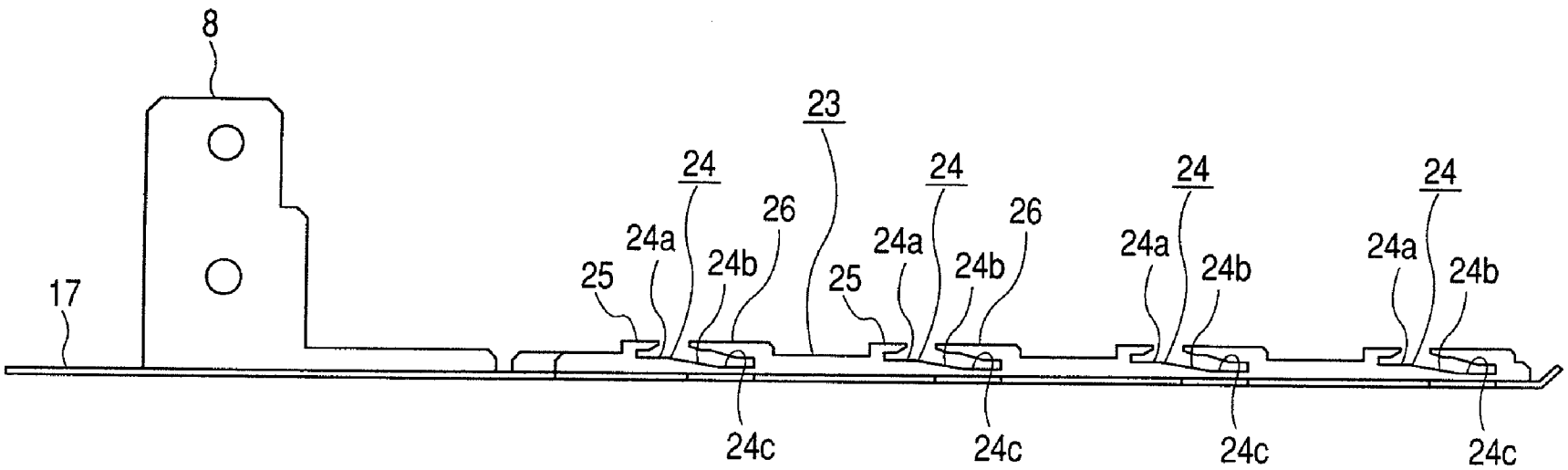
FIG. 5 is a view of a cam forming body of the receiving unit according to the embodiment of the present disclosure.

More specifically, as shown in FIG. 5, the cam shape of the cam forming body 23 is formed by a plurality of (four in FIG. 5) cam faces 24 having an identical end face shape, formed at an upper end portion of the cam forming body 23, and arranged at regular intervals in the longitudinal direction of the cam forming body 23. These cam faces 24 constitute a portion of a pressure contact and release mechanism.

As shown in FIG. 5, each cam face 24 is formed by a first cam face 24*a* that extends parallel in the longitudinal direction of the cam forming body 23, a second cam face 24*b* that is continuous to the right end of the first cam face 24*a* and is inclined downward as it goes rightward in FIG. 5 from the right end, and a third cam face 24*c* that is continuous to the right end of the second cam face 24*b* and extends parallel in the longitudinal direction of the cam forming body 23.

A first claw shaped portion 25 protrudes upward from the left end of the first cam face 24*a*, and the distal end of the first claw shaped portion 25 bends toward the first cam face 24*a* so that the first claw shaped portion 25 faces the first cam face 24*a* from the above.

A second claw shaped portion 26 protrudes upward from the right end of the third cam face 24*c*, and the distal end of the second claw shaped portion 26 bends toward the third cam face 24*c* so that the second claw shaped portion 26 faces the second cam face 24*b* and the third cam face 24*c* from the above.

As shown in FIGS. 3 and 4, a plate spring member 28 that is elongated in the longitudinal direction of the base portion 17 is arranged on the base portion 17 so as to be movable in the longitudinal direction of the base portion 17. The plate spring member 28 constitutes the pressure contact and release mechanism together with the cam faces 24.

In the vicinity of one end (the left end in FIGS. 3 and 4) in the longitudinal direction of the plate spring member 28, there is formed an elongated opening 29 that is slightly long in the width direction perpendicular to the longitudinal direction. The pivot regulation pin 22 is inserted down through the elongated opening 29. Moreover, the distal end of the pivot regulation pin 22 is inserted into the elongated, pivot regulation opening 21 after passing through the elongated opening 29 toward the bottom side in FIGS. 3 and 4.

The pivot regulation pin 22 makes abutting contact with the inner circumferential surface of the elongated opening 29 in accordance with the pivot operation of the attachment and detachment lever 18. With this abutting contact, the pivot operation of the attachment and detachment lever 18 is transmitted to the plate spring member 28, whereby the pivot operation is transformed to a linear movement of the plate spring member 28 in the longitudinal direction (loose fit direction) of the base portion 17.

The plate spring member 28 has a portion that is sandwiched by the paired cam forming body 23 (this portion will be referred to as a cam side portion 28*a*), a portion that is disposed close to the attachment and detachment lever 18 in the longitudinal direction (this portion will be referred to as a lever side portion 28*b*), and a step portion 30 between the two portions. The cam side portion 28*a* is disposed on a slightly upper side in FIGS. 3 and 4 than the lever side portion 28*b*.

At positions of both ends in the width direction perpendicular to the longitudinal direction of the plate spring member 28, facing the cam faces 24 from the inner side in the width direction, a number of claw-shaped cam followers 32 corresponding the number of cam faces 24 are formed so as to extend toward the corresponding cam faces 24. The respective cam followers 32 are in contact with the corresponding cam faces 24. In addition, as will be described later, the outer ends (distal ends) in the width direction of the cam followers 32 extend toward a further outer side in the width direction than the cam faces 24.

As shown in FIG. 3, in a state in which the attachment and detachment lever 18 is pivoted at the pressure contact pivot position, the plate spring member 28 is positioned at a first movement position (hereinafter, referred to as a pressure contact movement position) wherein it moves closest to the attachment and detachment lever 18), and at the same time, each of the cam followers 32 is positioned at a first cam position (hereinafter, referred to as a pressure contact cam position) wherein it makes contact with the first cam face 24*a*.

As shown in FIG. 4, in a state in which the attachment and detachment lever 18 is pivoted at the release pivot position, the plate spring member 28 is positioned at a second movement position (hereinafter, referred to as a release movement position) wherein it is separated furthest from the attachment and detachment lever 18), and at the same time, each of the cam followers 32 is positioned at a second cam position (hereinafter, referred to as a release cam position) wherein it makes contact with the third cam face 24*c*.

Although not shown in the drawings, in a state in which the attachment and detachment lever 18 is pivoted at a pivot position between the pressure contact pivot position and the release pivot position, the plate spring member 28 is positioned at a movement position between the pressure contact movement position and the release movement position, and at the same time, each of the cam followers 32 is positioned at a cam position between the pressure contact cam position and the release cam position wherein it makes contact with the second cam face 24*b*.

Therefore, the cam side portion 28*a* of the plate spring member 28 at the pressure contact cam position is positioned on an upper side in FIGS. 3 and 4 than when it is at the release cam position.

In addition, the plate spring member 28 is configured to be capable of applying urging force toward the upper side in FIGS. 3 and 4.

In the cam side portion 28*a* of the plate spring member 28, a plurality of (three in FIGS. 3 and 4) claw-shaped urging portions 33 are arranged at regular intervals in the longitudinal direction of the plate spring member 28 so as to protrude upward in FIGS. 3 and 4. The urging portions 33 are configured to apply urging force toward the upper side in FIGS. 3 and 4.

Figure 6:
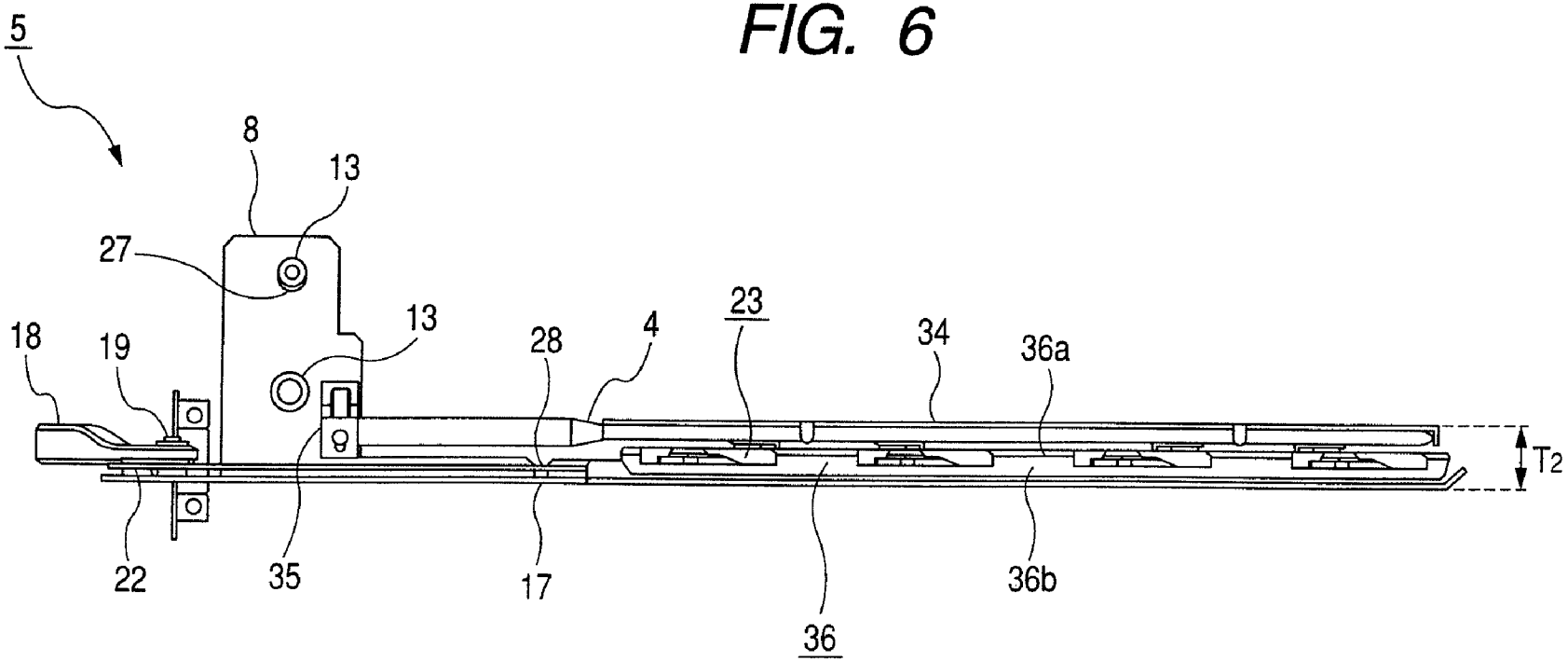
FIG. 6 is a view of the receiving unit according to the embodiment of the present disclosure, showing a cooling unit when an attachment and detachment lever is at a pivot state toward a pressure contact pivot position, also showing the thickness of the cooling unit inside a cavity thereof.

As shown in FIG. 6, at a position (the upper position in FIG. 6) opposite the base portion 17 with the plate spring member 28 disposed between them, the above-described U-shaped circulation pipe 4 that is elongated in the longitudinal direction of the plate spring member 28 is arranged in parallel to the plate spring member 28 and the base portion 17.

More specifically, the circulation pipe 4 is arranged such that a starting end at an outward path side where cooling water is supplied into the pipe and a terminating end at an inward path side where cooling water is discharged out of the pipe, i.e., both ends of the U shape are directed to the attachment and detachment lever 18; on the other hand, a terminating end at the outward path side and a starting end at the inward path side which is continuous to the terminating end, i.e., the bent portions of the U shape are directed to a side opposite to the attachment and detachment lever 18.

As shown in FIG. 6, the circulation pipe 4 is fixed at the bottom surface of a flat, pressure contact plate 34 that covers the circulation pipe 4 from the above in FIG. 6. The pressure contact plate 34 is contacted to the U-shaped portion of the circulation pipe 4 in a gapless manner (with no gap in the vertical direction) so that thermal conduction or transmission can be appropriately carried out between the pressure contact plate 34 and the circulation pipe 4. Although not shown in the drawings, the starting end at the outward path side of the circulation pipe 4 is coupled to a cooling water supply source, and the terminating end at the inward side is coupled to a cooling water discharge destination.

In addition, the circulation pipe 4 is held by a holding portion 35 fixed at the fixing portion 8 so as to be able to move in the vertical direction in FIG. 6.

A roof-shaped cover member 36 is provided between the circulation pipe 4 and the plate spring member 28 so as to cover the plate spring member 28 and the cam forming body 23, which constitute a portion of the pressure contact and release mechanism, from the above in FIG. 6. The cover member 36 extends in the longitudinal direction of the plate spring member 28.

Figure 7:
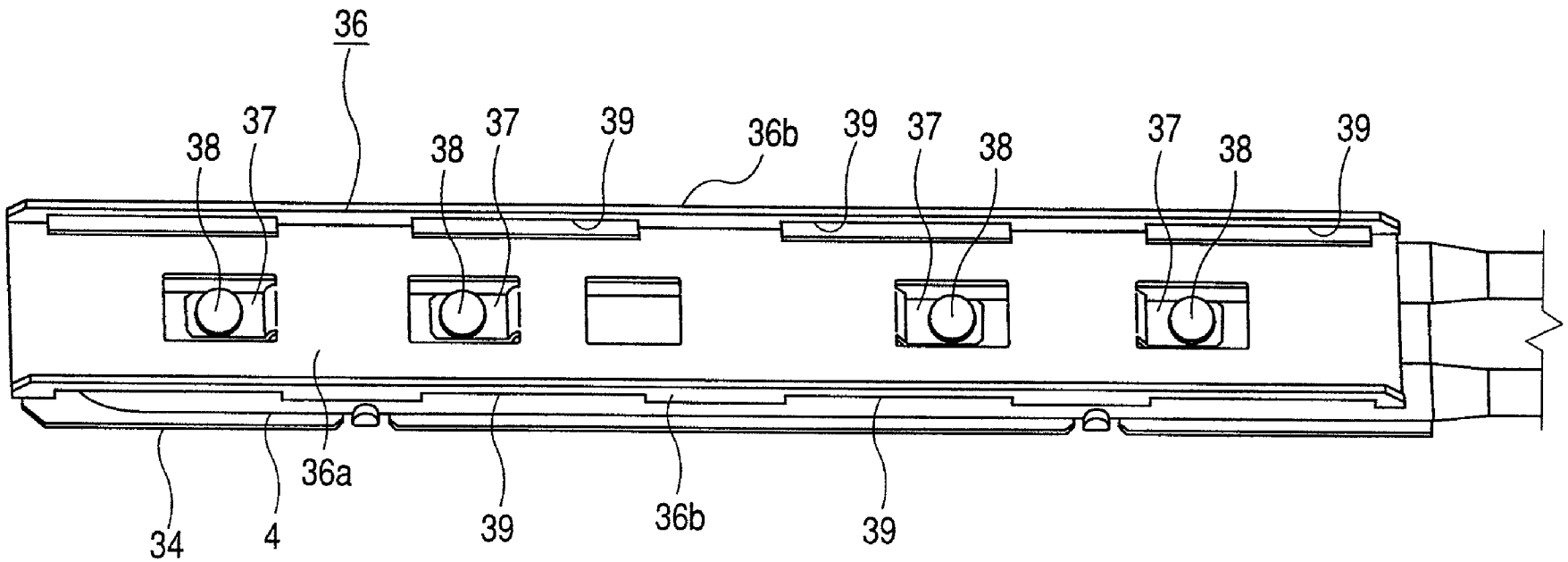
FIG. 7 is a view of the receiving unit according to the embodiment of the present disclosure, showing a cover member and a circulation pipe fixed at a pressure contact plate.

As shown in FIGS. 6 and 7, the cover member 36 is formed by an upper wall portion 36*a* that is parallel to the plate spring member 28 and left and right, sidewall portions 36*b* that extend from both ends of the upper wall portion 36*a* in the width direction perpendicular to the longitudinal direction toward the plate spring member 28 (toward the lower side in FIG. 6).

As shown in FIG. 7, a plurality of claw-shaped pressure contact plate fixing portions 37 are formed in the upper wall portion 36*a* of the cover member 36 so as to protrude toward the pressure contact plate 34. The pressure contact plate 34 is fixed at the pressure contact plate fixing portion 37 by means of a fastening member 38 such as bolts. Therefore, the cover member 36 is configured to be movable integrally with the pressure contact plate 34 and the circulation pipe 4 fixed at the pressure contact plate 34.

Figure 8:
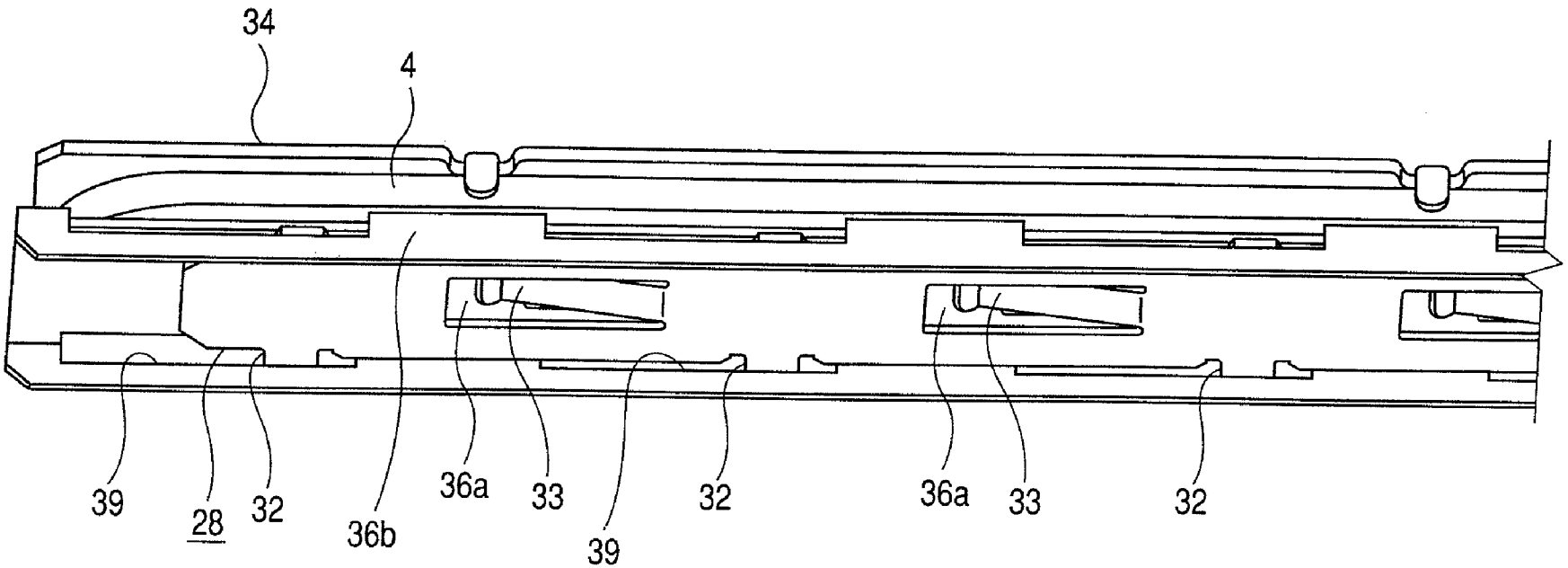
FIG. 8 is a view of the receiving unit according to the embodiment of the present disclosure, showing a plate spring member at a hold state in the cover member.

As shown in FIGS. 7 and 8, at mutually the same longitudinal positions of the left and right, sidewall portions 36*b* of the cover member 36, a number of (four) elongated plate spring holding openings 39 that are elongated in the longitudinal direction, corresponding to the number of cam followers 32 are formed at regular intervals in the longitudinal direction. In each elongated plate spring holding opening 39, a portion of the cam follower 32 extending toward further outer side in the width direction than the cam face 24 (this portion will be referred to as a distal end of the cam follower 32) is inserted.

In the present embodiment, the plate spring member 28 is held inside the cover member 36 in such a state that it is standing in the vertical direction in FIGS. 6 and 8 via the urging force of the urging portion 33. That is, as shown in FIG. 8, the urging portion 33 of the plate spring member 28 is brought into pressure contact with the bottom surface of the upper wall portion 36*a* of the cover member 36 via the urging force. Meanwhile, by a force resisting against the urging force, the distal end of the cam follower 32 is brought into pressure contact with the lower end of the inner circumferential surface of the elongated plate spring holding opening 39 from the above in FIG. 8. However, the pressure contact force of the urging portion 33 relative to the bottom surface of the upper wall portion 36*a* and the pressure contact force of the distal end of the cam follower 32 relative to the lower end of the inner circumferential surface of the elongated plate spring holding opening 39 are set such that it does not interfere the linear movement of the plate spring member 36 in the longitudinal direction.

With this configuration, when the plate spring member 28 moves between the pressure contact movement position and the pressure contact cam position and between the release movement position and the release cam position in accordance with the pivot operation of the attachment and detachment lever 18, the cover member 36, the pressure contact plate 34 and the circulation pipe 4 can be moved in an integral manner in the vertical direction in FIG. 6. Incidentally, the vertical direction in FIG. 6 corresponds to a direction where the circulation pipe 4 moves toward and away from the thermally conductive sheet 15 and the radiator plate 14.

Figure 9:
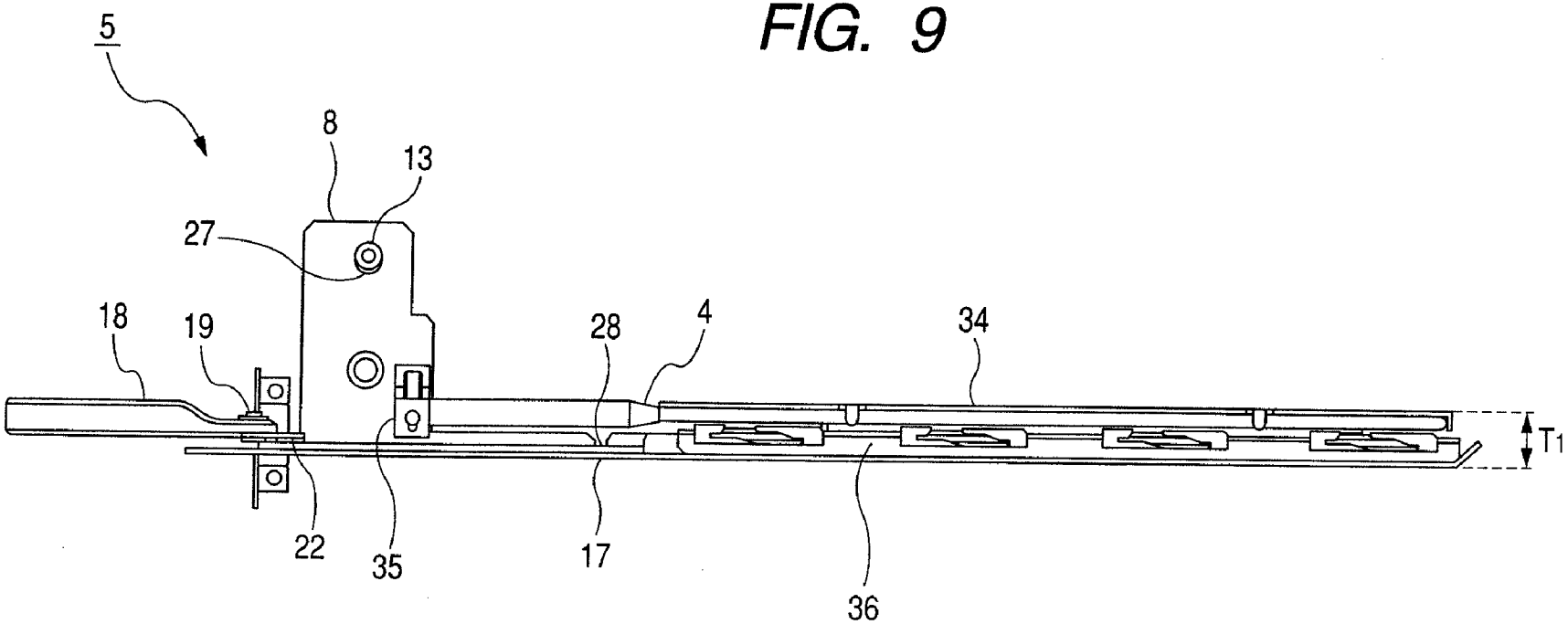
FIG. 9 is a view of the receiving unit according to the embodiment of the present disclosure, showing a cooling unit when the attachment and detachment lever is at a pivot state toward a release pivot position, also showing the thickness of the cooling unit inside a cavity thereof.
Figure 10:
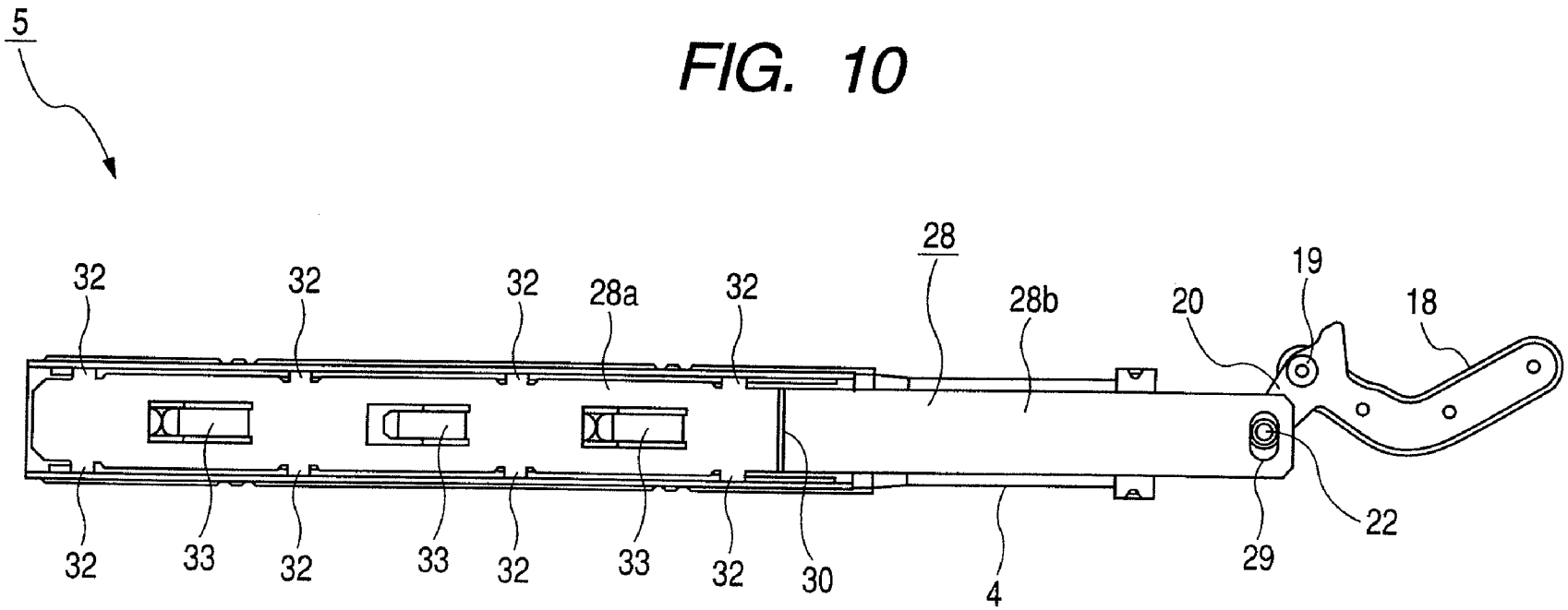
FIG. 10 is a schematic bottom view of the recording unit according to the embodiment of the present disclosure, showing a cooling unit excluding a cam forming body and a base portion when the attachment and detachment lever is at a pivot state toward a release pivot position.
Figure 11:
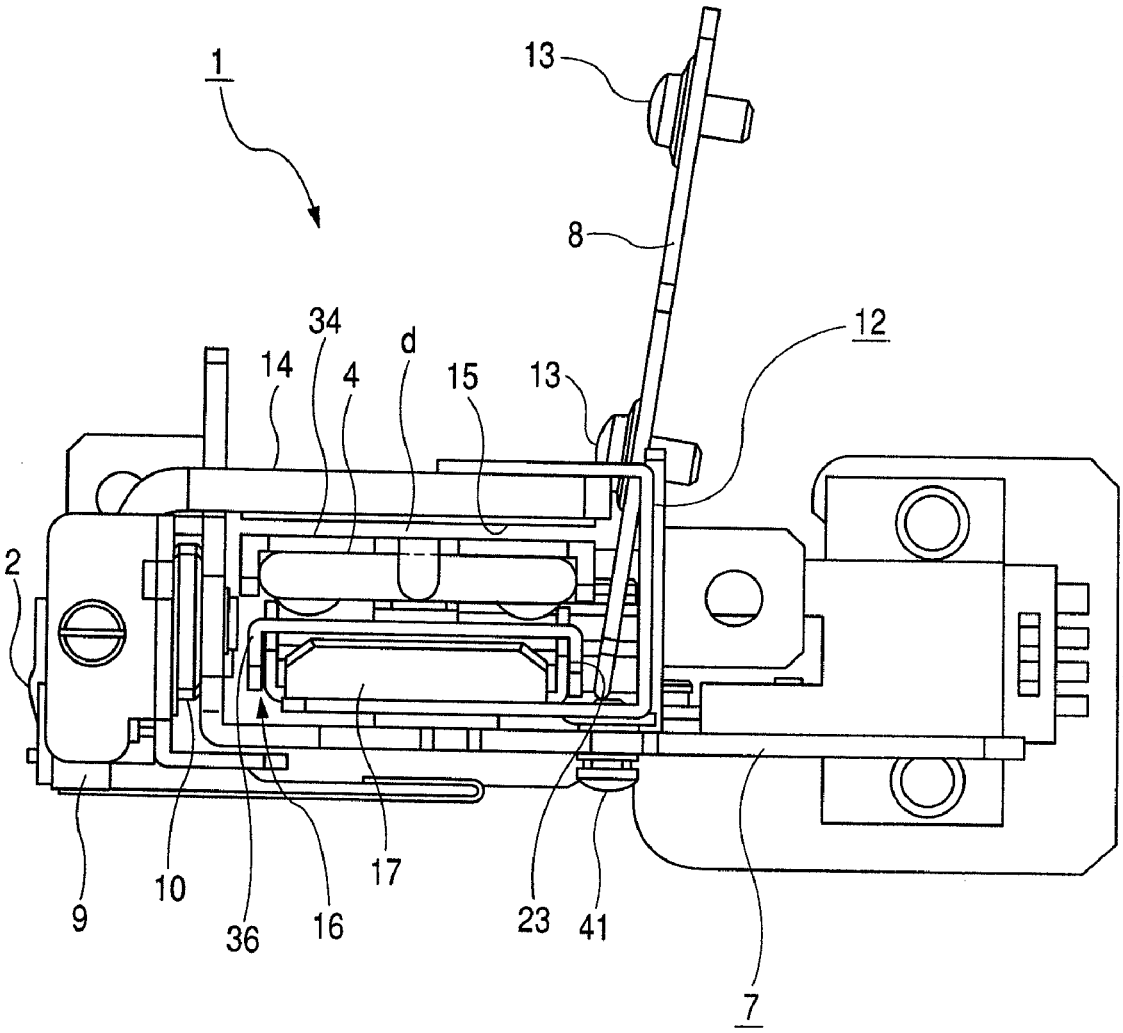
FIG. 11 is a view of the recording unit according to the embodiment of the present disclosure, showing a head unit at a separation allowed state from a cooling unit.

In the cooling unit 5 having such a construction, as shown in FIGS. 4, 9, and 10, when the attachment and detachment lever 18 is pivoted at the release pivot position and the head unit 3 is loosely fit in such a state that the plate spring member 28 is positioned at the release movement position and the release cam position, a gap d having a predetermined thickness in the vertical direction in FIG. 11 is formed between the upper surface of the pressure contact plate 34 and the thermally conductive sheet 15 opposed to the pressure contact plate 34, as shown in FIG. 11. This gap is formed because the thickness $T_1$ (see FIG. 9) of the cooling unit 5 inside the cavity 16 is smaller than the thickness (the size in the lengthwise direction in FIG. 11) of the cavity 16.

In the state shown in FIG. 11, the plate spring member 28 is separated furthest from the thermally conductive sheet 15, and the circulation pipe 4 is in such a state that it is released from the pressure contact with the thermally conductive sheet 15 and the radiator plate 14.

Figure 12:
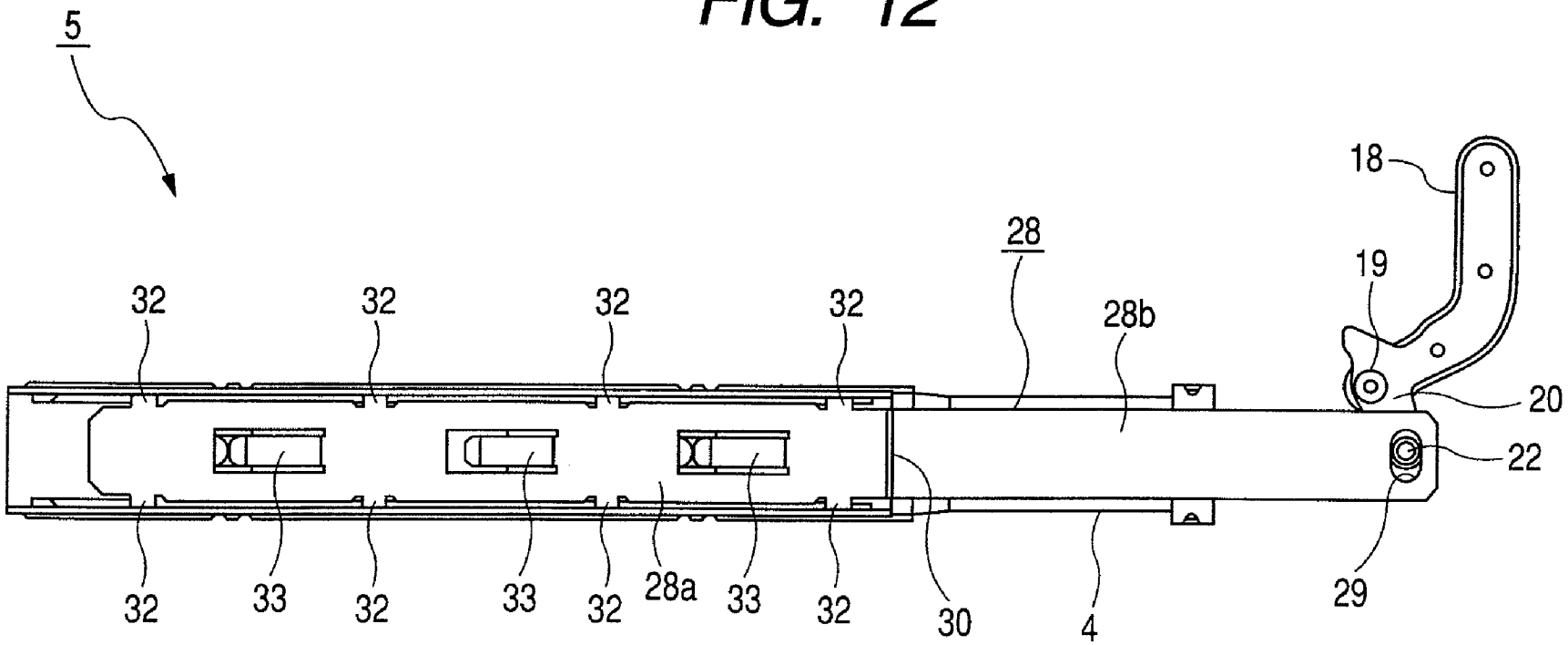
FIG. 12 is a schematic bottom view of the recording unit according to the embodiment of the present disclosure, showing a cooling unit excluding a cam forming body and a base portion when the attachment and detachment lever is at a pivot state toward a pressure contact pivot position.

In addition, when the cooling unit 5 is operated from the loose fit state shown in FIG. 11 to a state shown in FIGS. 3, 6 and 12, where the attachment and detachment lever 18 is pivoted at the pressure contact pivot position, and at the same time, the plate spring member 28 is moved to the pressure contact movement position and the pressure contact cam position, the thickness $T_2$ (see FIG. 6) of the cooling unit 5 inside the cavity 16 becomes identical with the thickness of the cavity 16.

Figure 13:
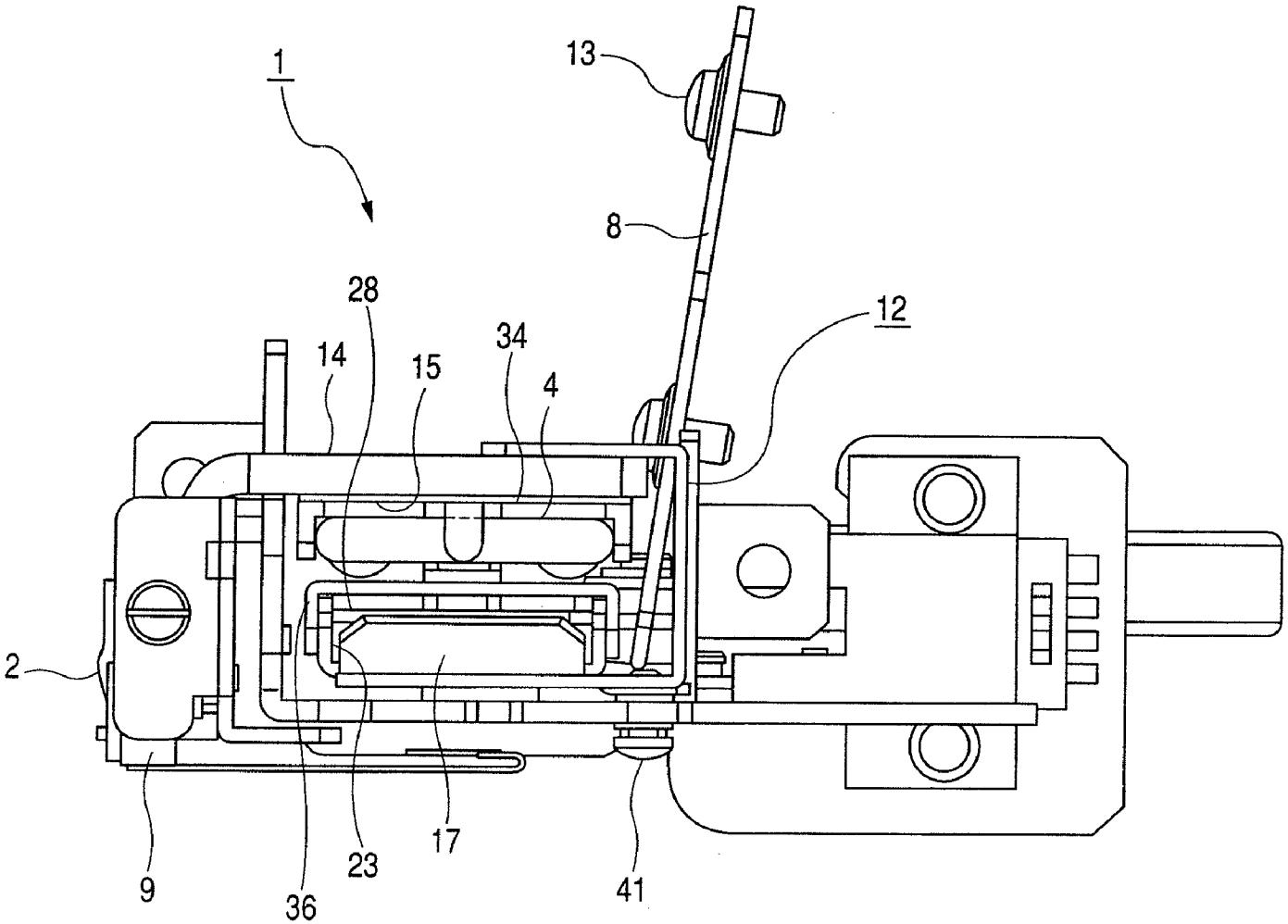
FIG. 13 is a view of the recording unit according to the embodiment of the present disclosure, showing a head unit at an attachment state to a cooling unit.

With this operation, as shown in FIG. 13, the circulation pipe 4 is moved to the pressure contact positive and thus the upper surface of the pressure contact plate 34 is brought into contact with the thermally conductive sheet 15 from the below.

At this time, in the plate spring member 28, a resilient force is generated in the vertical direction in FIG. 13 as the spring shape changes in the longitudinal direction with the movement of the plate spring member 28 toward the pressure contact cam position, and at the same time, an urging force is generated in the upward direction in FIG. 13 as a restoring force based on the resilient force. The urging force is applied to the circulation pipe 4 and the pressure contact plate 34 from the below, whereby the circulation pipe 4 is brought into pressure contact with the thermally conductive sheet 15 and the radiator plate 14 with the pressure contact plate 34 interposed between them.

In the state in which the circulation pipe 4 is in pressure contact with the thermally conductive sheet 15 and the radiator plate 14, the head unit 3 is held at an immovable state relative to the circulation pipe 4 via the cavity 16, whereby the head unit 3 can be attached to the cooling unit 5. To the contrary, in the state shown in FIG. 11 in which the circulation pipe 4 is released from the pressure contact with the thermally conductive sheet 15 and the radiator plate 14, the head unit 3 is allowed to be separated from the cooling unit 5 in a direction opposite to the loose fit direction.

Figure 14:
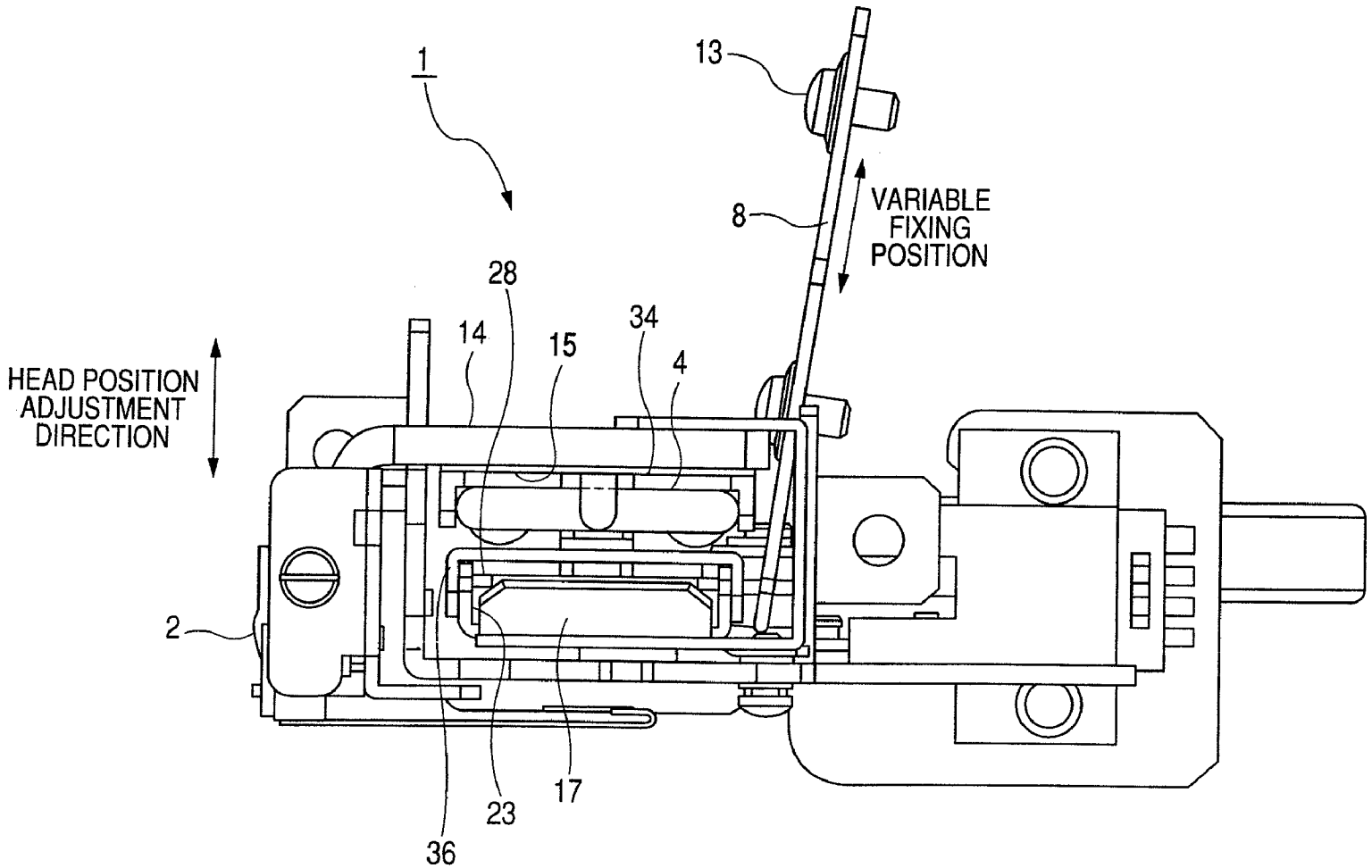
FIG. 14 is an explanatory view for illustrating a position adjustment operation of a line thermal head in the recording unit according to the embodiment of the present disclosure.

As shown in FIG. 14, in the present embodiment, by releasing the coupling between the head attachment mount 9 and the base frame 7 via the fixing means 10 shown in FIG. 1, the head attachment mount 9 can be moved in the vertical direction in FIG. 14 together with the line thermal head 2, the holder 12, the radiator plate 14, and the thermally conductive sheet 15, in a manner separate from the base frame 7.

Moreover, in the present embodiment, the fixing position of the fixing portion 8 relative to the thermal transfer printer body 6 is adjustable in the vertical direction in FIG. 14. Specifically, as shown in FIG. 6, by designing a through-bore 27 provided in the fixing portion 8 for threadable coupling of the fastening member 13 therewith into a vertically elongated opening shape, it is possible to adjust the fixing position of the fixing portion 8.

As a result, in the state where the head unit 3 is attached to the cooling unit 5, position adjustment of the position of the line thermal head 2 relative to the thermal transfer printer body 6 can be carried out in the vertical direction in FIG. 14.

Although the base frame 7 and the holder 12 are fixed to each other via the fastening member 41 such as bolts, the fastening member 41 may be provided in accordance with the needs.

Next, the operation of the present embodiment will be described.

In an initial state, as shown in FIG. 1, it will be assumed that the head unit 3 is detached from the cooling unit 5 and the attachment and detachment lever 18 is pivoted at the release pivot position.

At this time, as shown in FIGS. 4 and 10, the plate spring member 28 is moved to the release movement position and the release cam position, and the cam follower 32 is in contact with the third cam face 24*c*.

Next, the head unit 3 is moved in the loose fit direction as shown in FIG. 1 from the initial state to be loosely fit to the cooling unit 5 so that the cooling unit 5 is held in the state shown in FIG. 11 where a gap d between the pressure contact plate 34 and the thermally conductive sheet 15 is formed in the cavity 16.

At this time, the circulation pipe 4 is moved to a position where it is released from the pressure contact with the thermally conductive sheet 15 and the radiator plate 14.

Next, as shown in FIGS. 3 and 12, when the attachment and detachment lever 18 is pivoted to the pressure contact pivot position from the loose fit state (pressure contact release state) shown in FIG. 11, the plate spring member 28 is moved to the pressure contact movement position along the longitudinal direction of the base portion 17 in accordance with the pivot operation of the attachment and detachment lever 18. In addition, at this time, the plate spring member 18 is moved to the pressure contact cam position by the movement of the cam follower 32 from above the third cam face 24*c* to above the first cam face 24*a* over the second cam face 24*b*.

At this time, as for the cover member 36 covering the plate spring member 28, since the circulation pipe 4 coupled to the cover member 36 via the pressure contact plate 34 can only move in the vertical direction in FIG. 6 by the holding portion 35, the cover member 36 cannot move integrally with the plate spring member 28 in the longitudinal direction of the plate spring member 28.

However, at this time, the cover member 36 causes the distal end of the cam follower 32 to make sliding contact with the inner circumferential surface of the elongated plate spring holding opening 39, and at the same time, causes the urging portion 33 to make sliding contact with the bottom surface of the upper wall portion 36*a* (see FIG. 8). Therefore, the movement of the plate spring member 28 to the pressure contact movement position can be ensured.

Moreover, at this time, since the cover member 36 is allowed to move in the vertical direction in FIG. 6, the cover member 36 is moved in a direction toward the thermally conductive sheet 15 (in the upward direction in FIG. 6) inside the cavity 16 in accordance with the movement of the plate spring member 28 to the pressure contact cam position.

With this movement, the circulation pipe 4 coupled to the cover member 36 is moved to the pressure contact position as shown in FIG. 13, and at the pressure contact position, the circulation pipe 4 receives the urging force from the plate spring member 28 acting in the upward direction in FIG. 13, whereby the circulation pipe 4 is brought into pressure contact with the thermally conductive sheet 15 and the radiator plate 14 together with the pressure contact plate 34.

Then, by the pressure contact of the circulation pipe 4 with the thermally conductive sheet 15 and the radiator plate 14, the head unit 3 is held at an immovable state relative to the circulation pipe 4 in such a manner as to surround the circulation pipe 4. Therefore, the attachment of the head unit 3 relative to the cooling unit 5 can be completed in an easy and quick manner.

In the attachment state of the head unit 3, when thermal transfer printing is performed by heating the thermal elements of the line thermal head 2 while circulating cooling liquid in the circulation pipe 4, heat generated from the line thermal head 2 is transferred to the radiator plate 14 and the thermally conductive sheet 15 via the head attachment mount 9.

Then the heat transferred to the thermally conductive sheet 15 is deprived by the cooling water circulating in the circulation pipe 4 that is in pressure contact with the thermally conductive sheet 15 via the pressure contact plate 34, whereby the cooling of the line thermal head 2 can be carried out in a stable manner. At this time, the radiator plate 14 also assists the cooling of the line thermal head 2 by radiating heat to the atmosphere.

In this way, by performing thermal transfer printing accompanied by the cooling of the line thermal head 2, it is possible to prevent or suppress excessive transfer of ink of the ink ribbon, with the result that printing can be appropriately performed on a recording material.

Meanwhile, when separating the head unit 3 from the cooling unit 5, the attachment and detachment lever 18 at the attachment state of the head unit 3 (at the pressure contact state of the circulation pipe 4) is pivoted from the pressure contact pivot position to the release pivot position to thereby release the pressure contact of the circulation pipe 4. Thereafter, the head unit 3 is removed from the cooling unit 5 in a direction opposite to the loose fit direction. Therefore, similar to the attachment, the separation of the head unit 3 can be carried out in a simple and quick manner.

As described above, according to the present embodiment, by attaching or separating the head unit 3 to or from the cooling unit 5 by the pressure contact and release operation of the circulation pipe 4 in cooperation with the plate spring member 28, the cam face 24, and the cover member 36 in accordance with the pivot operation of the attachment and detachment lever 18, the replacement of the line thermal head 2 can be carried out in a simple and quick manner. In the present embodiment, the base frame 7 is fixed at the thermal transfer printer body 6 by means of bolts, as described above. However, since the fixation of the head unit 3 is also carried out by the operation of the attachment and detachment lever 18, the number of bolt fixing positions in the head unit 3 can be decreased as much as possible. Therefore, it does not complicate the replacement of the line thermal head.

Moreover, in the present embodiment, during attachment of the head unit 3 to the cooling unit 5, the circulation pipe 4 is brought into pressure contact with the thermally conductive sheet 15, thereby ensuring that the head unit 3 is stably held outside the circulation pipe 4 and thus ensuring the effective cooling of the line thermal head 2. Therefore, thermal transfer printing can be carried out in an appropriate and stable manner.

The present disclosure is not limited to the embodiments described above but may be modified in a variety of ways in accordance with needs.

For example, the radiator plate 14 can be formed from a variety of metallic materials such as aluminum or copper having excellent thermal conductivity.

Similarly, the thermally conductive sheet 15 can be formed from materials such as silicon rubber having excellent thermal conductive properties.

Moreover, the present disclosure can be applied to any printer of a thermal sublimation transfer type or a thermal fusion transfer type as long as it is capable of thermal transfer printing.

The terms and descriptions used herein are set forth by way of illustration only and are not meant as limitations. Those skilled in the art will recognize that many variations can be made to the details of the above-described embodiments without departing from the underlying principles of the disclosure. The scope of the disclosure should therefore be determined only by the following claims (and their equivalents) in which all terms are to be understood in their broadest reasonable sense unless otherwise indicated.

What is claimed is:

1. A recording unit mounted on a thermal transfer printer in which heating or thermal elements of a thermal head are heated so that ink of an ink ribbon is thermally transferred to a recording material, the recording unit comprising:

a head unit having the thermal head; and a cooling unit having a cooling medium flow path that circulates a cooling medium to thereby cool down the thermal head by the cooling medium, wherein the cooling unit is fixed at a predetermined position in a thermal transfer printer body, and the head unit is detachably attached to the cooling unit, wherein the head unit is provided with a cavity through which a head unit body is loosely fit to the cooling unit in a predetermined loose fit direction in such a manner as to surround the cooling medium flow path, the cavity being surrounded by a heat transfer member that is arranged so as to be opposed to the cooling medium flow path to receive heat generated from the thermal head in a state where the head unit body is loosely fit to the cooling unit and a holder having a wall portion opposed to the heat transfer member, wherein the cooling unit comprises:

a lever that is pivotable between a first pivot position and a second pivot position; and a pressure contact and release mechanism that is configured to bring the cooling medium flow path into pressure contact with the heat transfer member in accordance with the pivot operation of the lever toward the first pivot position when the head unit body is at the loose fit state and to release the pressure contact of the cooling medium flow path in accordance with the pivot operation of the lever toward the second pivot position in a state where the cooling medium flow path is in pressure contact with the heat transfer member, and wherein the cooling unit is configured to cause the head unit to be held at an immovable state relative to the cooling medium flow path in such a manner as to surround the cooling medium flow path by the pressure contact of the cooling medium flow path by means of the pressure contact and release mechanism, whereby the head unit is attached to the head unit body in such a state that cooling of the thermal head can be carried out by the cooling medium flow path, and whereby separation of the head unit from the cooling unit body is allowed by the release of the pressure contact by means of the pressure contact and release mechanism.

2. The recording unit according to claim 1, wherein the pressure contact and release mechanism comprises:

a plate spring member that is disposed in the cavity so to be opposed to the heat transfer member with the cooling medium flow path disposed therebetween when the head unit body is at the loose fit state, the plate spring member being movable in the loose fit direction between a first movement position corresponding to the first pivot position and a second movement position corresponding to the second pivot position in accordance with the pivot operation of the lever; and a cam structure that moves the plate spring member to a first cam position wherein the plate spring member moves closest toward the heat transfer member in accordance with movement of the plate spring member toward the first movement position when the head unit body is at the loose fit state and that moves the plate spring member to a second cam position wherein the plate spring member is separated furthest from the heat transfer member in accordance with movement of the plate spring member toward the second movement position in a state where the head unit is attached to the cooling unit body, and wherein the pressure contact and release mechanism is configured to move the cooling medium flow path to a position wherein it makes pressure contact with the heat transfer member in accordance with movement of the plate spring member toward the first cam position, to cause urging force of the plate spring member acting toward the heat transfer member to be applied to the cooling medium flow path at the pressure contact position, and to thereby move the cooling medium flow path to a position wherein it is released from the pressure contact in accordance with movement of the plate spring member toward the second cam position.

3. The recording unit according to claim 1, wherein the thermal head is configured such that its position is adjustable while allowing integrated movement with the thermal head, the heat transfer member, and the holder in a state where the head unit is attached to the cooling unit body, and wherein the cooling unit is configured such that its own fixation position relative to the thermal transfer printer body can be changed in accordance with the movement of the thermal head during the position adjustment of the thermal head when the head unit is at the attachment state.

4. The recording unit according to claim 1, wherein the heat transfer member comprises:

a metallic radiator plate that extends from the vicinity of the thermal head to a position opposed to the cooling medium flow path when the head unit body is at the loose fit state; and a thermally conductive sheet that is provided on a surface of the radiator plate opposed to the cooling medium flow path when the head unit body is at the loose fit state.

5. The recording unit according to claim 1, wherein the thermal head is a line thermal head.

* * * * *